US007261699B1

(12) United States Patent
Wu

(10) Patent No.: US 7,261,699 B1
(45) Date of Patent: Aug. 28, 2007

(54) ECCENTRIC SWIVEL TYPE MASSAGING DEVICE

(76) Inventor: Dong-Her Wu, 141, Chang Shui Rd., Sec. 2, Pu Yen Cun, Pu Yen Hsiang, Chang Hua Hsien (TW)

( * ) Notice: Subject to any disclaimer, the term of this patent is extended or adjusted under 35 U.S.C. 154(b) by 290 days.

(21) Appl. No.: 11/042,465

(22) Filed: Jan. 25, 2005

(51) Int. Cl.
*A61H 1/00* (2006.01)

(52) U.S. Cl. ..... 601/72; 601/67; 601/112

(58) Field of Classification Search ..... 601/15, 601/17, 18, 67, 69, 70, 72, 73, 80, 84, 85, 601/87, 89, 93, 94, 112, 113, 134, 135, 136–138
See application file for complete search history.

(56) References Cited

U.S. PATENT DOCUMENTS 3,906,940 A * 9/1975 Kawada ..... 601/6
5,183,034 A * 2/1993 Yamasaki et al. ..... 601/70
5,925,002 A * 7/1999 Wollman ..... 601/70

* cited by examiner

*Primary Examiner*—Quang D. Thanh
(74) *Attorney, Agent, or Firm*—Alan Kamrath; Kamrath & Associates PA

(57) ABSTRACT

A massaging device includes a main body, a massaging member rotatably and eccentrically mounted on the main body, and a covering member mounted on the main body to encompass the massaging member completely. Thus, the shade of the covering member encompasses the massaging member completely, so that the massaging member will not be exposed outward from the main body, thereby providing a better viewing effect to the user. In addition, the shade of the covering member encompasses the massaging member completely to prevent dirt or dust from entering the massaging member and the main body, thereby facilitating maintenance of the massaging device.

6 Claims, 6 Drawing Sheets

ECCENTRIC SWIVEL TYPE MASSAGING DEVICE

BACKGROUND OF THE INVENTION

1. Field of the Invention

The present invention relates to a massaging device, and more particularly to an eccentric swivel type massaging device that can produce vibration eccentrically so as to provide a massaging effect.

2. Description of the Related Art

A conventional eccentric swivel type massaging device in accordance with the prior art shown in FIGS. 5 and 6 comprises a main body 30, and a massaging member 31 rotatably and eccentrically mounted on the main body 30. The massaging member 31 produces an eccentric rotation relative to the main body 30 by a drive motor (not shown) co-operating with a connecting member (not shown) mounted in the main body 30. In operation, when the massaging member 31 is rotated on the main body 30 eccentrically, the eccentric rotation of the massaging member 11 produces vibration, thereby providing a massaging effect to the user. However, the massaging member 31 is protruded and exposed outward from the main body 30, thereby providing an uncomfortable viewing effect to the user. In addition, the massaging member 31 is exposed outward from the main body 30, so that dirt or dust easily enters the gap between the massaging member 31 and the main body 30, thereby contaminating the massaging device.

SUMMARY OF THE INVENTION

In accordance with the present invention, there is provided a massaging device, comprising: a main body; a massaging member rotatably and eccentrically mounted on the main body; and a covering member mounted on the main body to encompass the massaging member completely.

The primary objective of the present invention is to provide an eccentric swivel type massaging device that can produce vibration eccentrically so as to provide a massaging effect.

Another objective of the present invention is to provide a massaging device, wherein the shade of the covering member encompasses the massaging member completely, so that the massaging member will not be exposed outward from the main body, thereby providing a better viewing effect to the user.

A further objective of the present invention is to provide a massaging device, wherein the shade of the covering member encompasses the massaging member completely to prevent dirt or dust from entering the massaging member and the main body, thereby facilitating maintenance of the massaging device.

A further objective of the present invention is to provide a massaging device, wherein the shade of the covering member covers the massaging member and the main body, thereby enhancing the outer appearance of the massaging device.

Further benefits and advantages of the present invention will become apparent after a careful reading of the detailed description with appropriate reference to the accompanying drawings.

DETAILED DESCRIPTION OF THE INVENTION

Figure 1:
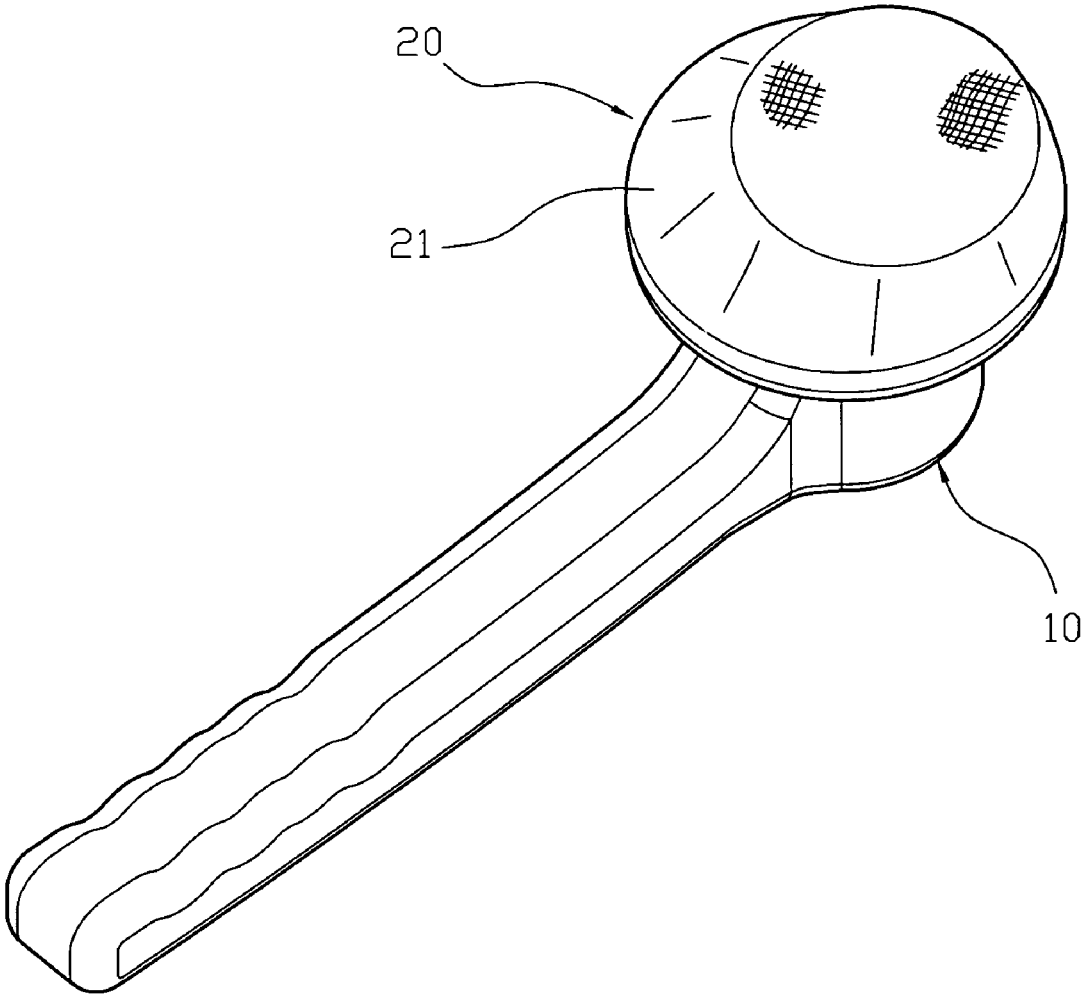
FIG. 1 is a perspective view of a massaging device in accordance with the preferred embodiment of the present invention.
Figure 2:
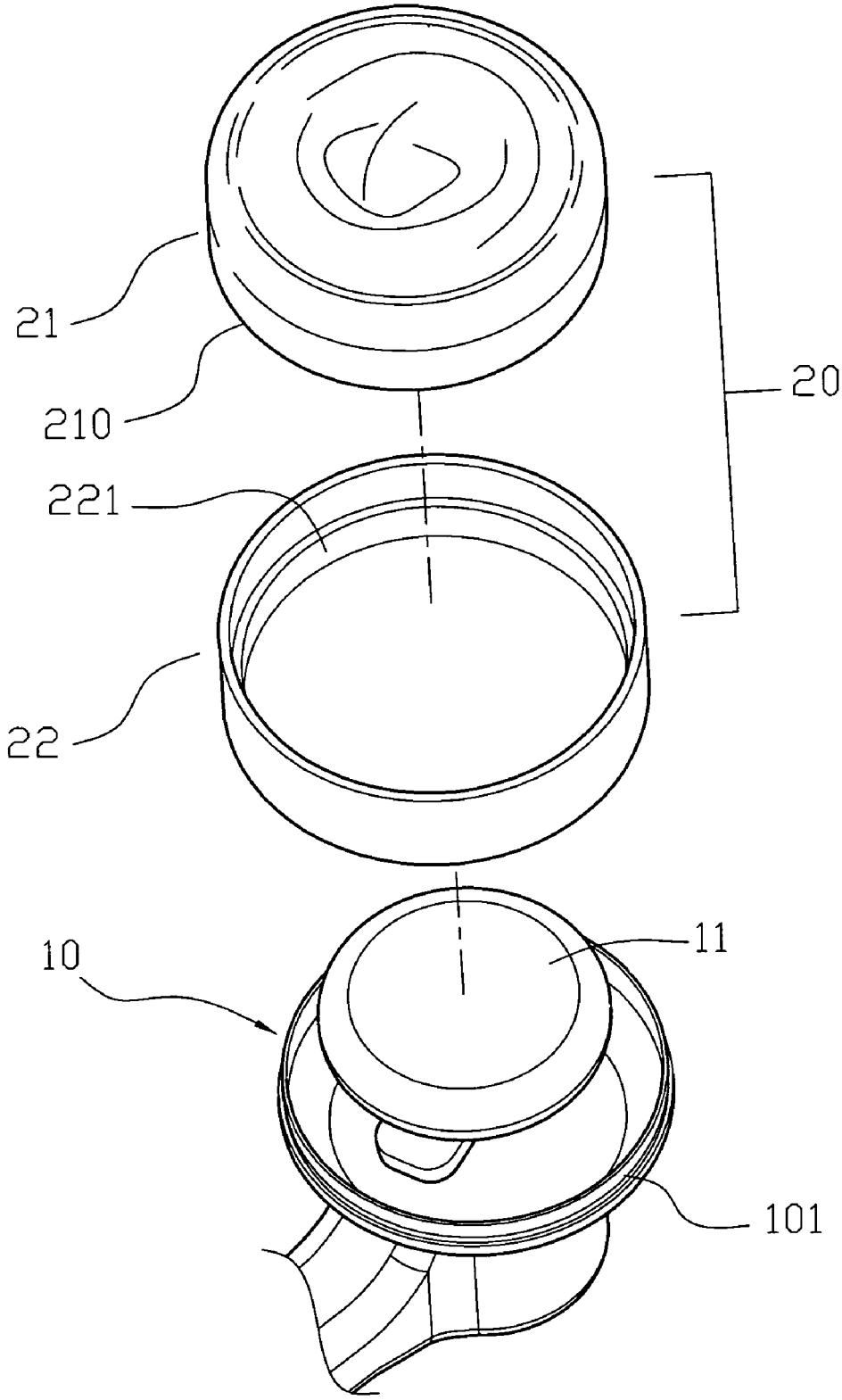
FIG. 2 is a partially cut-away exploded perspective view of the massaging device as shown in FIG. 1.
Figure 3:
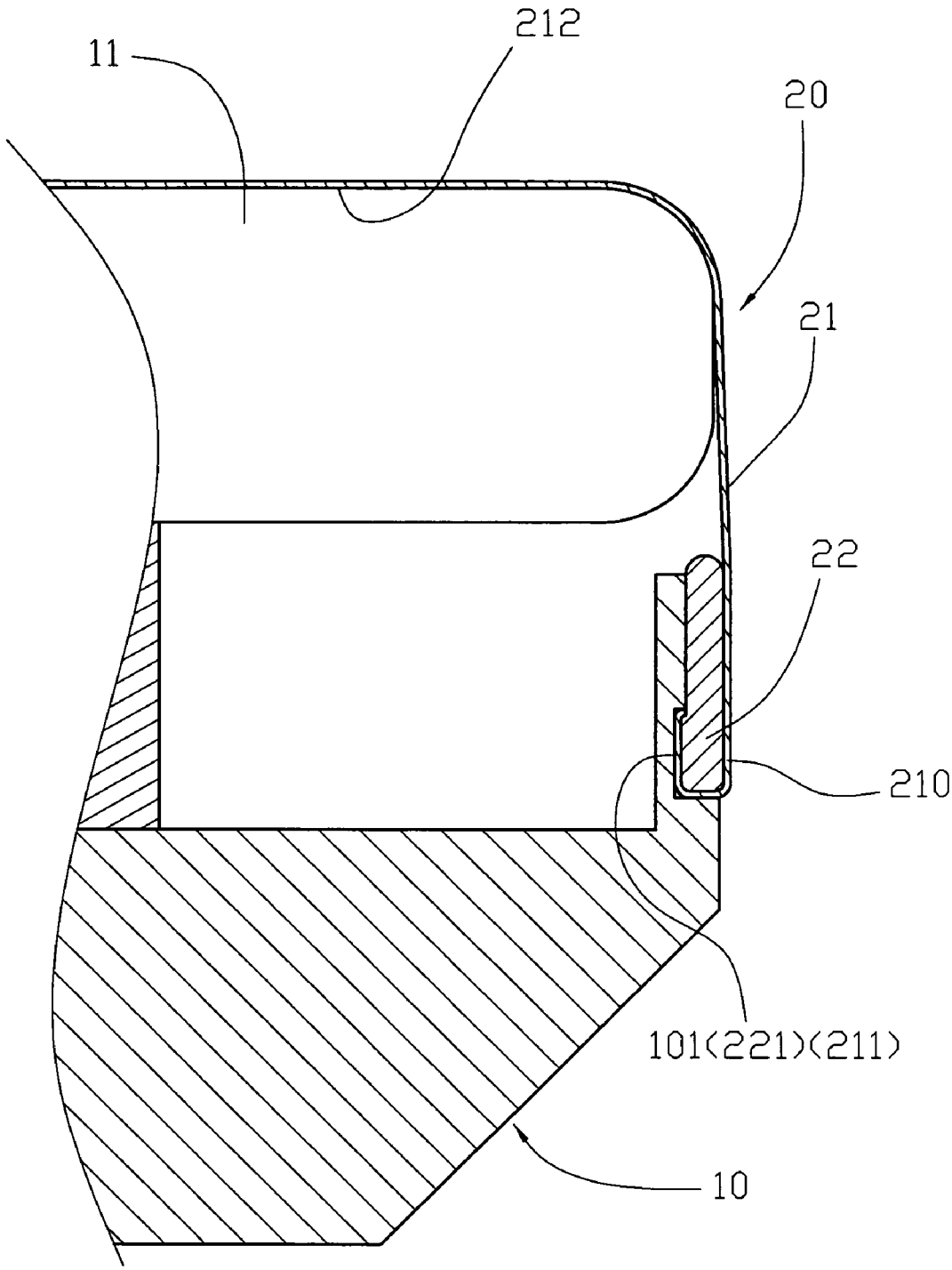
FIG. 3 is a partially cut-away plan cross-sectional view of the massaging device as shown in FIG. 1.
Figure 4:
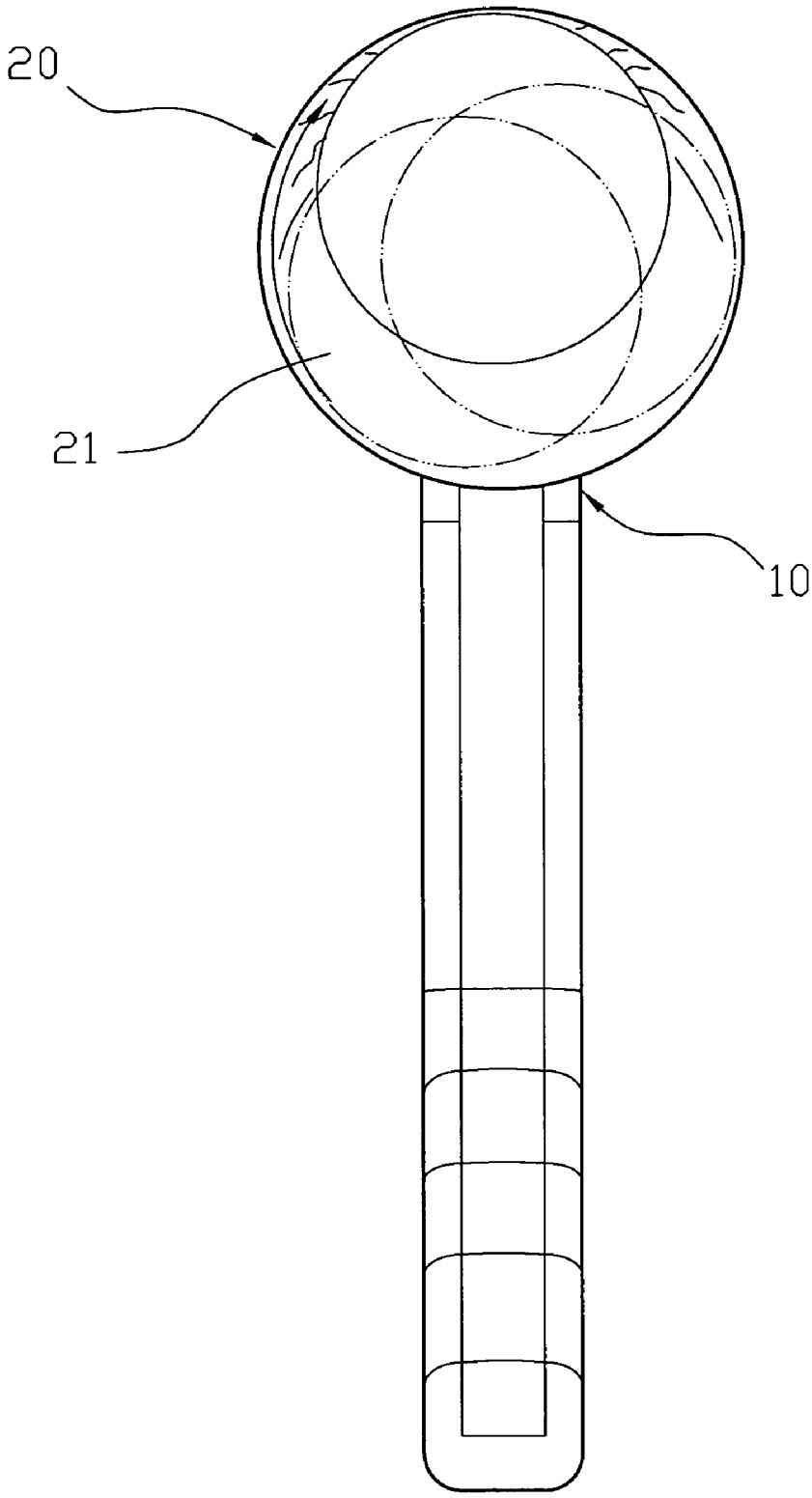
FIG. 4 is a schematic plan operational view of the massaging device as shown in FIG. 1 in use.
Figure 5:
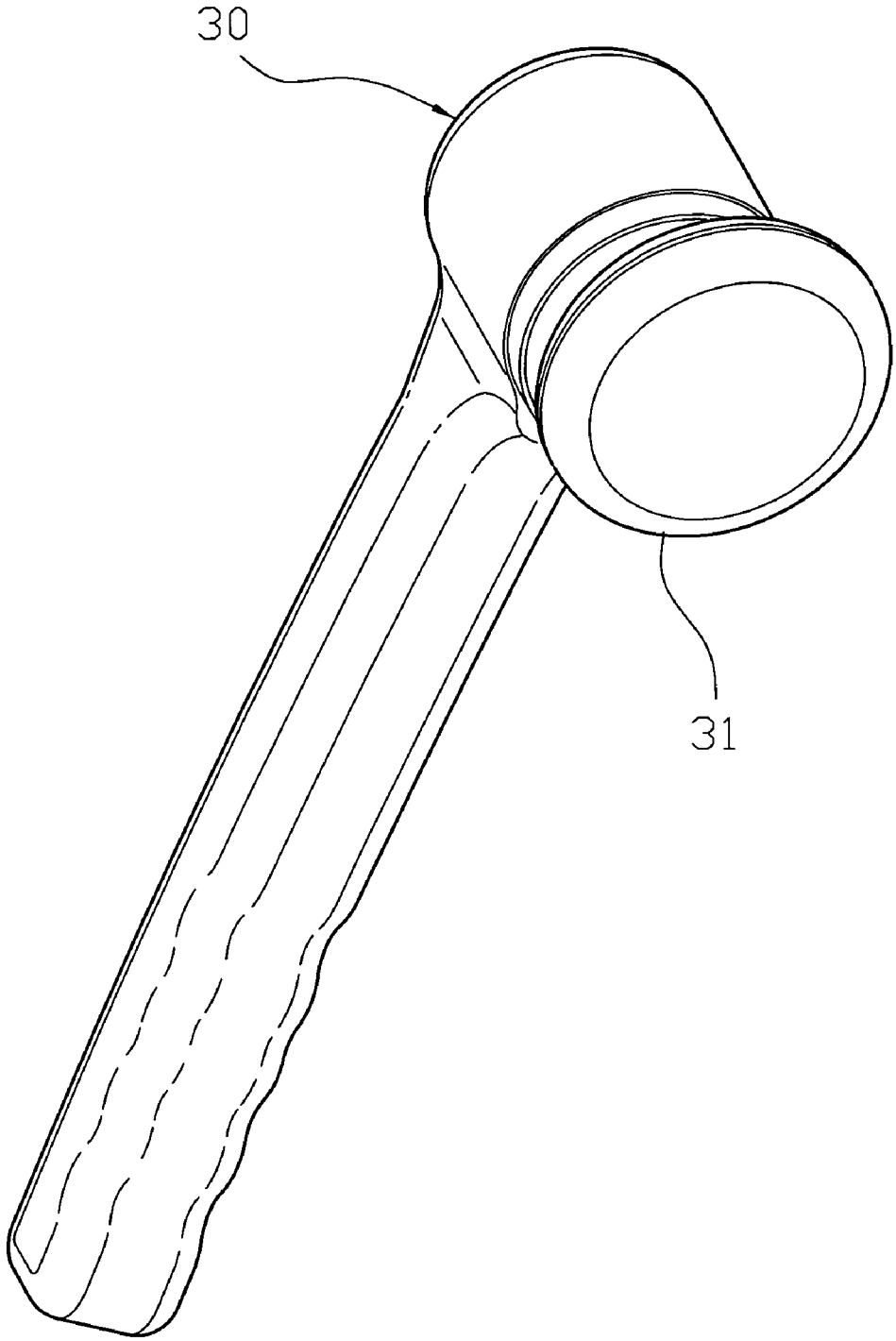
FIG. 5 PRIOR ART
FIG. 5 is a perspective view of a conventional massaging device in accordance with the prior art.
Figure 6:
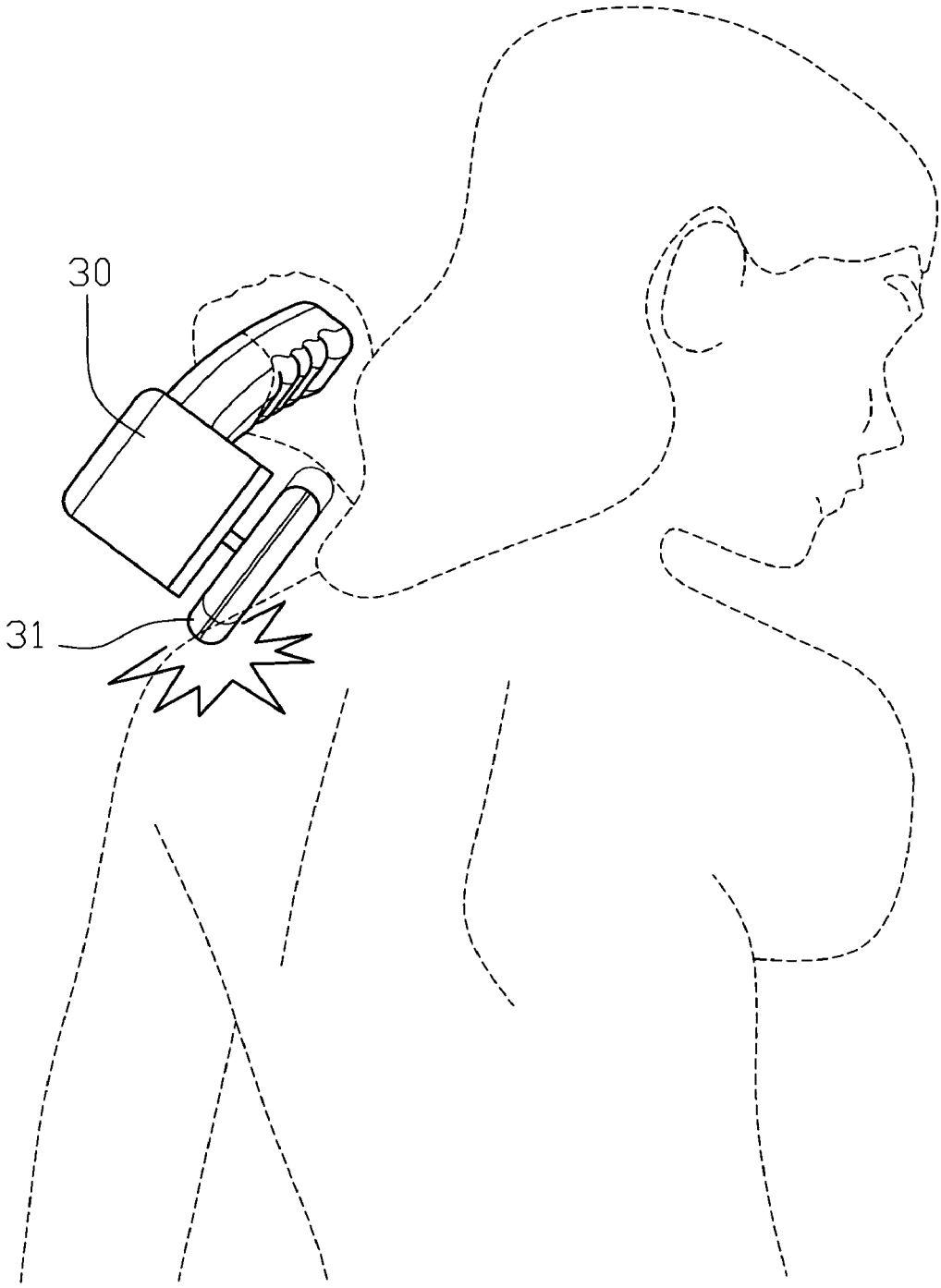
FIG. 6 PRIOR ART
FIG. 6 is a schematic plan operational view of the conventional massaging device as shown in FIG. 5 in use.

Referring to the drawings and initially to FIGS. 1-3, a massaging device in accordance with the preferred embodiment of the present invention comprises a main body 10, a massaging member 11 rotatably and eccentrically mounted on the main body 10, and a covering member 20 mounted on the main body 10 to encompass the massaging member 11 completely. The massaging member 11 produces an eccentric rotation relative to the main body 10 by a drive motor (not shown) co-operating with a connecting member (not shown) mounted in the main body 10.

The main body 10 has a peripheral wall formed with an annular locking groove 101.

The covering member 20 includes a shade 21 secured on the main body 10 to encompass the massaging member 11 completely, and a retaining ring 22 mounted between the shade 21 and the main body 10 to fix the shade 21 on the main body 10.

The shade 21 of the covering member 20 is made of soft material and has an inside formed with a receiving chamber 212 to encompass the massaging member 11 completely.

The retaining ring 22 of the covering member 20 has an inner wall formed with an annular locking flange 221 detachably inserted into and locked in the locking groove 101 of the main body 10, so that the retaining ring 22 is fixed on the main body 10.

The shade 21 of the covering member 20 has an open lower peripheral wall 210 rested on an outer wall of the retaining ring 22. The lower peripheral wall 210 of the shade 21 is formed with a hook-shaped bent portion 211 rested on the inner wall of the retaining ring 22 and located between the locking groove 101 of the main body 10 and the locking flange 221 of the retaining ring 22, so that the shade 21 is secured on the peripheral wall of the main body 10 by the retaining ring 22.

When the shade 21 of the covering member 20 is worn out during a long-term utilization, the locking flange 221 of the retaining ring 22 is detached from the locking groove 101 of the main body 10 to detach the retaining ring 22 from the main body 10 so as to release the shade 21 from the main body 10, thereby facilitating a user replacing the shade 21.

In operation, referring to FIGS. 1-4, when the massaging member 11 is rotated on the main body 10 eccentrically, the shade 21 of the covering member 20 produces vibration due to the eccentric rotation of the massaging member 11, thereby providing a massaging effect to the user.

Accordingly, the shade 21 of the covering member 20 encompasses the massaging member 11 completely, so that the massaging member 11 will not be exposed outward from the main body 10, thereby providing a better viewing effect to the user. In addition, the shade 21 of the covering member 20 encompasses the massaging member 11 completely to prevent dirt or dust from entering the massaging member 11 and the main body 10, thereby facilitating maintenance of the massaging device. Further, the shade 21 of the covering member 20 covers the massaging member 11 and the main body 10, thereby enhancing the outer appearance of the massaging device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A massaging device, comprising:

a main body;

a massaging member rotatably and eccentrically mounted on the main body;

a covering member mounted on the main body to encompass the massaging member completely; wherein:

the covering member includes a shade secured on the main body to encompass the massaging member completely;

the covering member further includes a retaining ring mounted between the shade and the main body to fix the shade on the main body;

the main body has a peripheral wall formed with an annular locking groove, and the retaining ring of the covering member has an inner wall formed with an annular locking flange detachably inserted into and locked in the locking groove of the main body, so that the retaining ring is fixed on the main body;

the shade of the covering member has an open lower peripheral wall rested on an outer wall of the retaining ring;

the lower peripheral wall of the shade is formed with a bent portion rested on the inner wall of the retaining ring and located between the locking groove of the main body and the locking flange of the retaining ring, so that the shade is secured on the peripheral wall of the main body by the retaining ring.

2. The massaging device in accordance with claim 1, wherein the shade of the covering member is made of soft material.

3. The massaging device in accordance with claim 1, wherein the shade of the covering member has an inside formed with a receiving chamber to encompass the massaging member completely.

4. The massaging device in accordance with claim 1, wherein the bent portion of the lower peripheral wall of the shade is substantially hook-shaped.

5. The massaging device in accordance with claim 1, wherein the locking flange of the retaining ring is detached from the locking groove of the main body to detach the retaining ring from the main body so as to release the shade from the main body, thereby facilitating a user replacing the shade.

6. The massaging device in accordance with claim 1, wherein the shade of the covering member encompasses the massaging member, so that the massaging member is not exposed outward from the main body.

* * * * *